US007657948B2

(12) United States Patent
Tsai

(10) Patent No.: US 7,657,948 B2
(45) Date of Patent: Feb. 9, 2010

(54) PIVOTAL SHOWER DEVICE

(76) Inventor: Pi Kuang Tsai, 3F-6, No. 321, Daduen 4th Street, Nantun, Taichung (TW) 40867

( * ) Notice: Subject to any disclaimer, the term of this patent is extended or adjusted under 35 U.S.C. 154(b) by 446 days.

(21) Appl. No.: 11/807,990

(22) Filed: May 30, 2007

(65) Prior Publication Data

US 2008/0295242 A1 Dec. 4, 2008

(51) Int. Cl.
*A47K 3/022* (2006.01)
*A47K 3/34* (2006.01)

(52) U.S. Cl. ..... 4/615; 4/605; 4/567; 239/289

(58) Field of Classification Search ..... 4/615, 4/601, 567, 605; 239/289
See application file for complete search history.

(56) References Cited

U.S. PATENT DOCUMENTS 4,072,397 A * 2/1978 Ross ..... 4/597
4,557,003 A * 12/1985 Jones ..... 4/605
4,836,668 A * 6/1989 Christianson ..... 4/605
4,901,927 A 2/1990 Valdivia ..... 239/446
5,032,015 A * 7/1991 Christianson ..... 4/605
5,058,271 A * 10/1991 Jursich et al. ..... 30/123
5,604,633 A * 2/1997 Christianson ..... 4/605
5,749,552 A 5/1998 Fan ..... 248/205.8
5,953,157 A * 9/1999 Christianson ..... 359/509
6,036,110 A * 3/2000 Kanatzar et al. ..... 239/317
6,238,052 B1 * 5/2001 Zadro ..... 359/507
6,442,775 B1 9/2002 Gransow et al. ..... 4/601
6,799,335 B1 * 10/2004 Zadro ..... 4/605

* cited by examiner

*Primary Examiner*—Khoa D Huynh

(57) ABSTRACT

A shower device includes a hollow frame having a coupler for engaging with a wall-mounted shower supply pipe and having two tubes attached to two end portions, a housing having a chamber formed by an outer peripheral wall and having two openings for rotatably receiving the tubes, a cover engaged with the housing and having two protrusions engaged with the openings of the housing and for anchoring the cover to the housing, a casing disposed in the housing and having two ports, and two distributors each having a pipe rotatably engaged into the tube and a mouth engaged with the port of the casing for supplying the water from the tubes into the chamber of the casing and then flowing out through the cover.

4 Claims, 7 Drawing Sheets

PIVOTAL SHOWER DEVICE

BACKGROUND OF THE INVENTION

1. Field of the Invention

The present invention relates to a shower device, and more particularly to a shower device including a pivotal structure for easily and readily and quickly attaching to a wall-mounted shower faucet or shower supply pipe and for allowing the shower device to be suitably operated by the users.

2. Description of the Prior Art

Typical shower devices or shower mounting facilities or shower head assemblies comprise one or more shower heads attached or coupled to a wall-mounted shower faucet or shower supply pipe for supplying water and for conducting the shower operations.

For example, U.S. Pat. No. 4,901,927 to Valdivia discloses one of the typical dual shower head assemblies comprising a lower shower head and an upper shower head attached or coupled to a wall-mounted shower faucet or shower supply pipe with connecting conduits and arranged for allowing the shower heads to be suitably pivoted relative to the wall-mounted shower faucet or shower supply pipe.

However, the pivotal operation of the shower heads is limited and the shower heads may not be easily pivoted or rotated to any suitable or selected position or direction.

U.S. Pat. No. 5,749,552 to Fan discloses another typical shower head mounting assembly comprising an upper shower head or shower attachment fixedly attached or secured or coupled to the wall-mounted shower faucet or shower supply pipe, and a lower shower head or shower attachment pivotally attached or coupled to the wall-mounted shower faucet or shower supply pipe with connecting conduits or posts.

However, the pivotal or rotational operation of the shower attachments is also limited and the shower attachments may not be easily pivoted or rotated to any suitable or selected position or direction.

U.S. Pat. No. 6,442,775 to Gransow et al. discloses a further typical pivotal dual-head shower fixture comprising a stationary base body fixed to a wall and coupled to a wall-mounted mixing faucet with a hose, a U-shaped tube pivotally attached or coupled to the base body, and two identical shower heads pivotally attached or coupled to the U-shaped tube for allowing the shower heads to be pivoted and rotated relative to the wall-mounted shower faucet to any suitable or selected position or direction.

However, the shower heads are required to be pivotally attached or coupled to the U-shaped tube which is then attached to the stationary base body, and the stationary base body is then required to be attached or coupled to the wall-mounted shower faucet with a hose, such that the typical pivotal dual-head shower fixture comprises a complicated structure that may greatly increase the manufacturing cost for the typical pivotal dual-head shower fixture and that may not be easily installed or mounted by the users themselves.

The present invention has arisen to mitigate and/or obviate the afore-described disadvantages of the conventional shower mounting facilities or shower head assemblies.

SUMMARY OF THE INVENTION

The primary objective of the present invention is to provide a shower device including a pivotal structure for easily and readily and quickly attaching to a wall-mounted shower faucet or shower supply pipe and for allowing the shower device to be suitably operated by the users.

In accordance with one aspect of the invention, there is provided a shower device comprising a frame including a coupler provided and attached to a middle portion thereof and having an inner thread formed in the coupler for easily and quickly and readily engaging with or attaching to a wall-mounted shower supply pipe, and including a conduit formed in the frame and communicating with the coupler for receiving a water, the frame including two end portions each having a tube attached to the frame, and including a bore formed in each of the tubes and communicating with the conduit of the frame for receiving the water, and including a space formed between the tubes, and the tubes being aligned with each other in a longitudinal axis and each including an open end facing toward and communicating with the space of the frame, a housing including a chamber formed by an outer peripheral wall, and including two openings oppositely formed in the outer peripheral wall for receiving the tubes respectively and for rotatably attaching the housing to the frame, a cover engaged with the housing and including two protrusions extended from an outer peripheral fence of the cover for engaging with the openings of the housing and for anchoring the cover to the housing, and including a number of holes formed in the cover, a casing disposed in the chamber of the housing and including two ports formed therein, and including a chamber formed in the casing and formed by an outer peripheral wall, and two distributors each including a pipe rotatably engaged into the bore of the tube respectively, and each including a mouth engaged with the port of the casing for supplying the water from the tubes into the chamber of the casing and then for allowing the water to flow from the chamber of the casing and then to flow out through the cover.

The casing includes two studs extended therefrom, and the distributors each include a bar extended therefrom and engaged with the studs of the casing and secured to the studs of the casing with such as fasteners.

The casing includes two orifices formed therein, and the cover includes two posts extended therefrom and engaged through the orifices of the casing.

The distributors each include a lever extended therefrom and engaged with the posts of the cover and secured to the posts of the cover with such as fasteners.

The casing includes a cap secured to the casing, the cap includes two orifices formed therein for receiving the posts of the cover respectively and for anchoring the cap of the casing to the cover.

The cap includes a number of apertures formed therein and aligned with the holes of the cover respectively, a guide plate is disposed in the chamber of the casing, and includes two orifices formed therein for receiving the posts of the cover respectively and for anchoring the guide plate to the cover, and includes a number of nozzles extended therefrom and engaged into the apertures of the cap and the holes of the cover respectively, and includes a number of passages formed in the nozzles respectively for allowing the water to flow out through the passages of the nozzles of the guide plate.

The housing includes at least one notch formed in the outer peripheral wall and communicating with the chamber of the housing, and the cover includes at least one catch extended out of the outer peripheral fence for engaging with the notch of the housing and for anchoring the cover to the housing.

The housing includes a mirror attached onto the housing. For example, the housing includes a recess formed therein for receiving and supporting the mirror.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
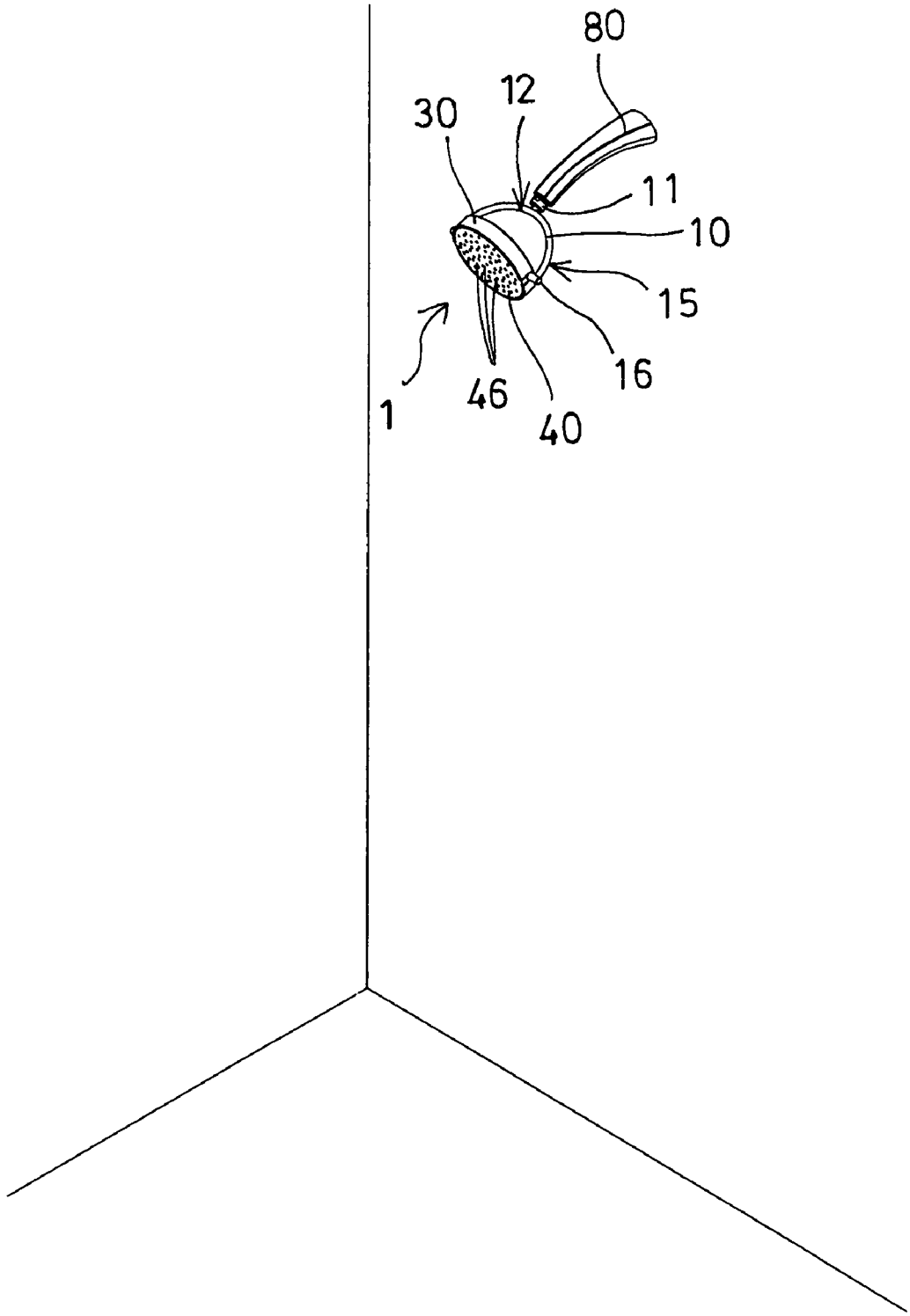
FIG. 1 is a perspective view of a shower device in accordance with the present invention.
Figure 2:
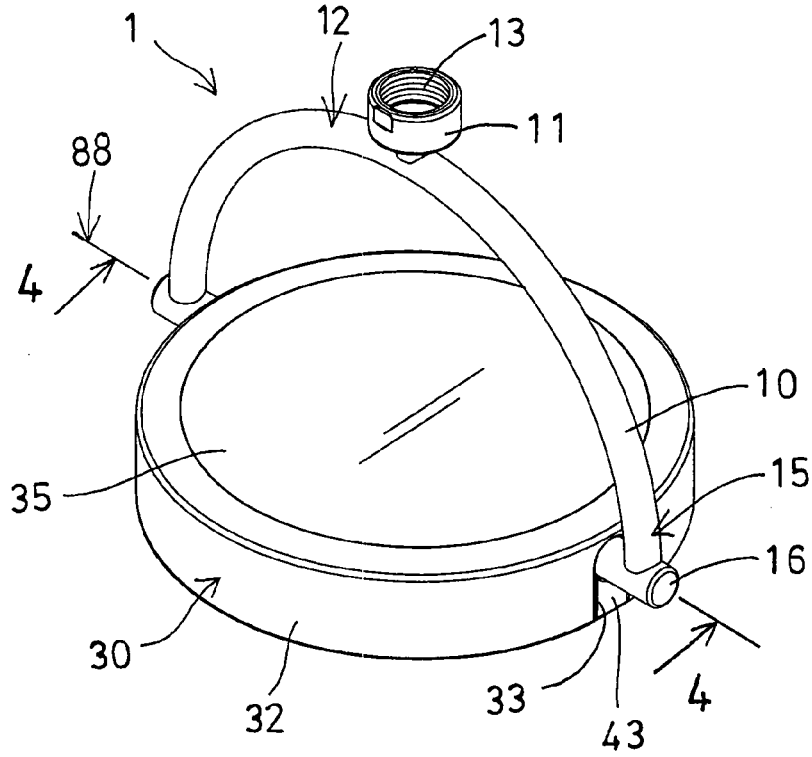
FIG. 2 is an upper perspective view of the shower device.
Figure 3:
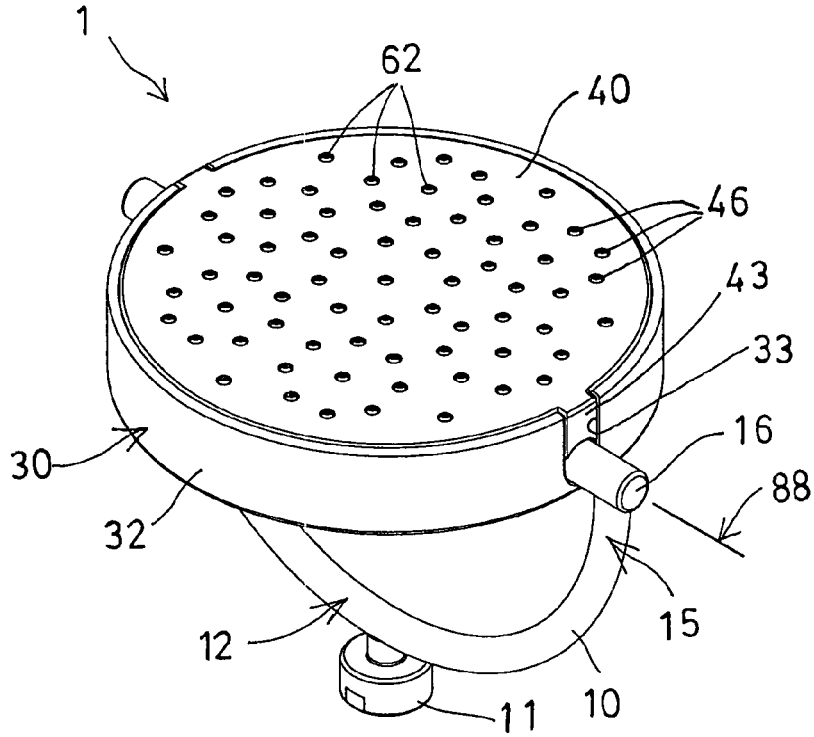
FIG. 3 is a bottom perspective view of the shower device.
Figure 4:
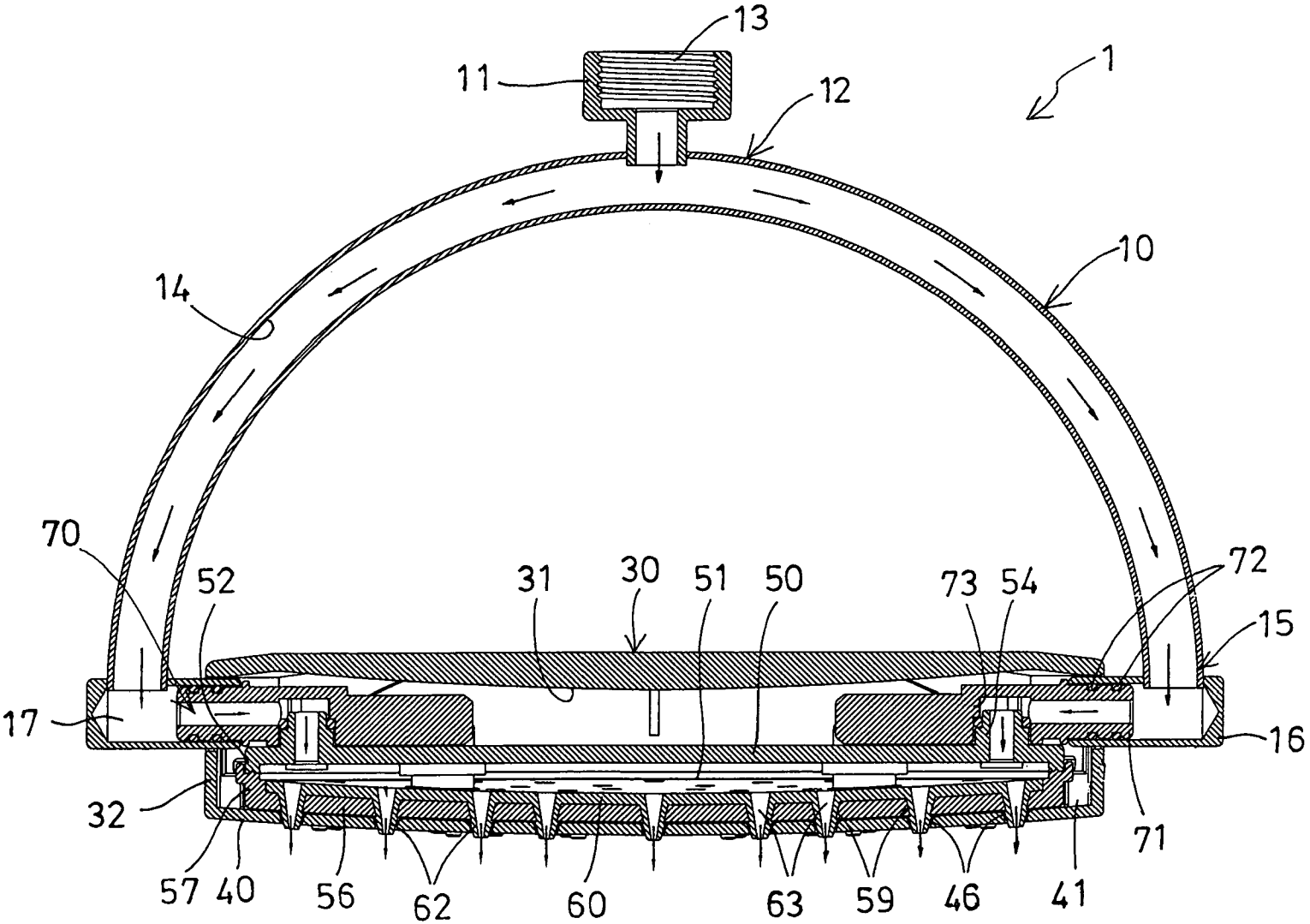
FIG. 4 is a cross sectional view of the shower device taken along lines 4-4 of FIG. 2.
Figure 5:
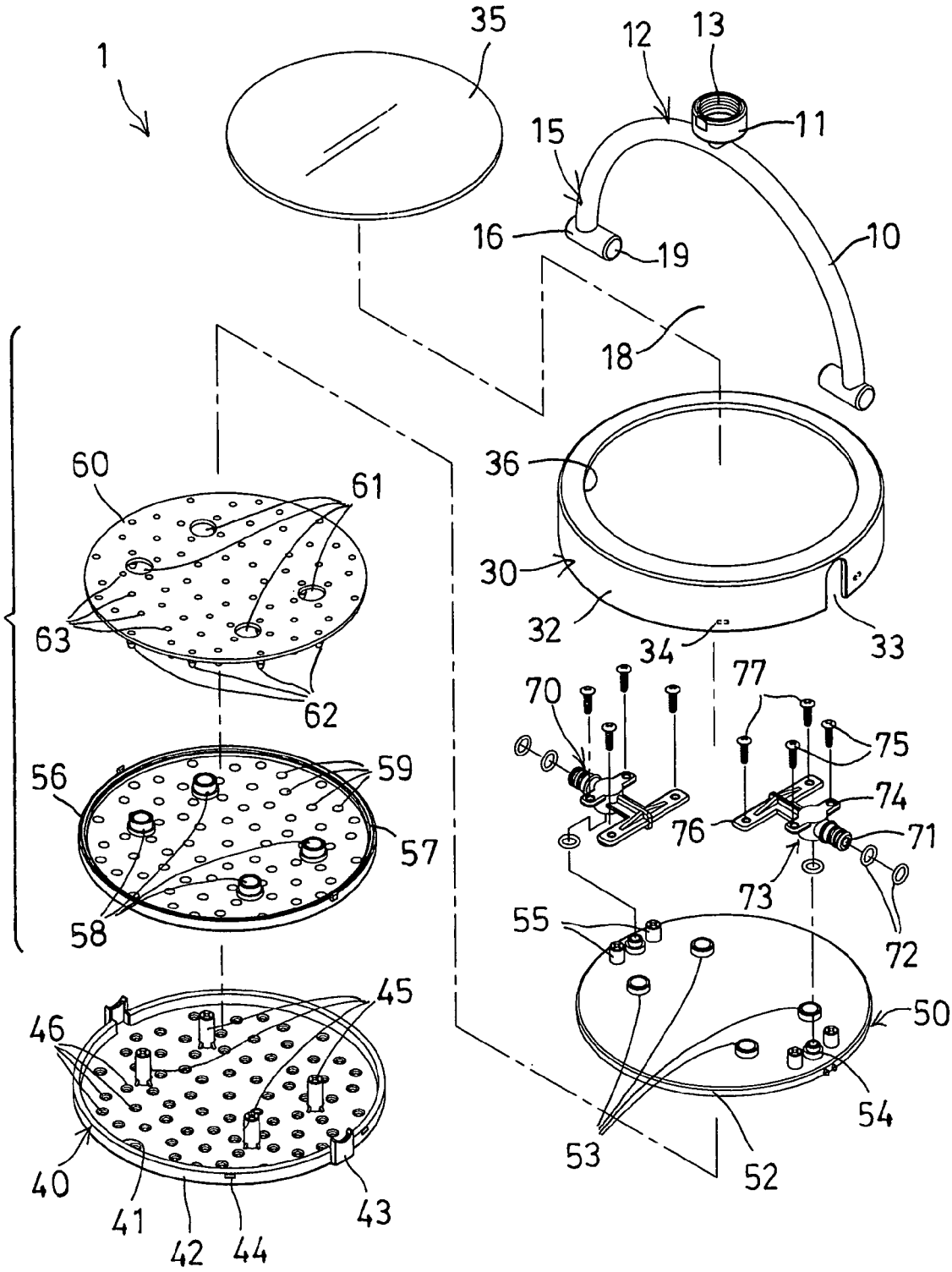
FIG. 5 is an exploded view of the shower device.

Referring to the drawings, and initially to FIGS. 1-5, a shower device 1 in accordance with the present invention comprises a curved or arched or C-shaped arm or frame 10 including a mouth or coupler 11 formed or provided and attached to a middle portion 12 thereof and having a screw hole or inner thread 13 formed in the inner peripheral portion of the coupler 11 for threading with or for easily and quickly and readily engaging with a wall-mounted shower faucet or shower supply pipe 80 (FIGS. 1 and 7-8) for coupling to the water reservoir, and including a conduit 14 formed in the inner portion of the frame 10 and communicating with the coupler 11 for receiving the water.

Figure 6:
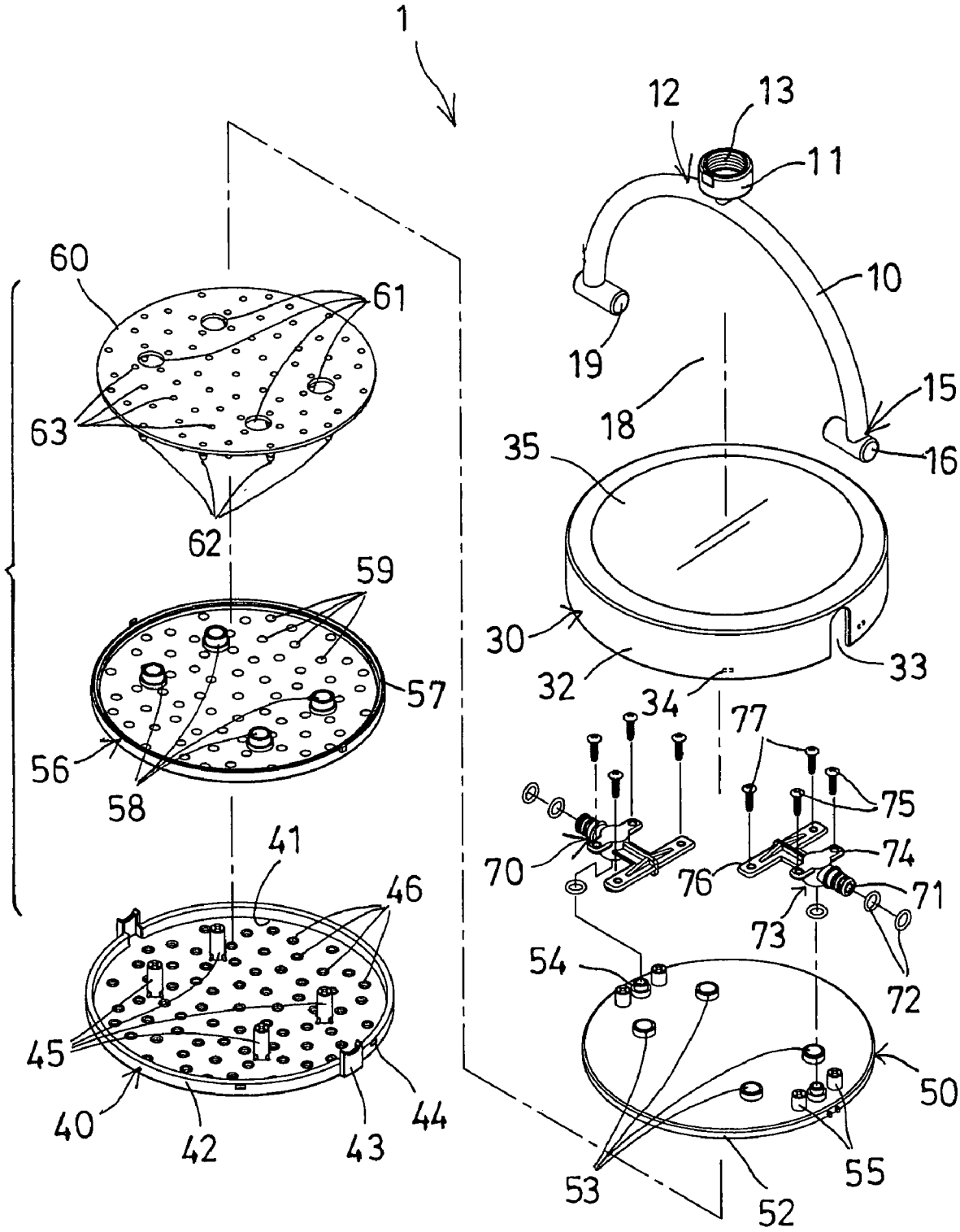
FIG. 6 is an exploded view similar to FIG. 5, illustrating the other arrangement of the shower device.

The frame 10 includes two end portions 15, and a tube 16 attached to each of the end portions 15 and having a bore 17 formed therein (FIG. 4) and communicating with the conduit 14 of the frame 10 for receiving the water. Due to the curved or arched or C-shaped structure for the frame 10, a space 18 will be formed between the tubes 16 (FIGS. 5, 6), and the tubes 16 are aligned with each other or include a common longitudinal axis 88 (FIGS. 2, 3), and each include an open end 19 facing toward and communicating with the space 18 of the frame 10 for rotatably attaching or securing or coupling a shower housing 30.

The housing 30 includes a chamber 31 formed therein (FIG. 4) and formed or defined by an outer peripheral wall 32, and includes two openings 33 oppositely formed in the outer peripheral wall 32 for receiving the tubes 16 respectively (FIGS. 2-4) and for rotatably attaching or securing or coupling the housing 30 to the frame 10. The housing 30 further includes one or more notches 34 formed in the inner peripheral portion of the outer peripheral wall 32 (FIGS. 5, 6) and communicating with the chamber 31 of the housing 30, and a mirror 35 selectively attached onto the housing 30, for example, the housing 30 includes a recess 36 formed therein (FIG. 5) for receiving and supporting the mirror 35.

A cover 40 includes a compartment 41 formed therein (FIGS. 5, 6) and formed or defined by an outer peripheral fence 42 for engaging into the opened bottom portion of the chamber 31 of the housing 30, and includes two protrusions 43 extended from the outer peripheral fence 42 of the cover 40 for engaging into the openings 33 of the housing 30 and for anchoring or positioning the cover 40 to the housing 30, and for limiting and preventing the cover 40 from being deeply engaged into the housing 30. The cover 40 includes one or more catches 44 extended outwardly from the outer peripheral fence 42 for engaging with the notches 34 of the housing 30 and for anchoring or latching or securing the cover 40 to the housing 30, and includes one or more posts 45 extended into the compartment 41 of the cover 40, and includes a number of holes 46 formed therein.

A casing 50 is disposed in the chamber 31 of the housing 30 and/or the compartment 41 of the cover 40, and includes a chamber 51 formed therein (FIG. 4) and formed or defined by an outer peripheral wall 52, and includes one or more hubs or orifices 53 formed therein for receiving the posts 45 of the cover 40 respectively and for anchoring or positioning the casing 50 to the cover 40, and includes two ports 54 formed therein or extended outwardly therefrom, and includes one or more studs 55 extended outwardly therefrom, and includes a cap 56 having an outer peripheral fence 57 for engaging into the chamber 51 of the casing 50 or for attaching or securing to the bottom of the casing 50. The cap 56 includes one or more hubs or orifices 58 formed therein for receiving the posts 45 of the cover 40 respectively and for anchoring or positioning the cap 56 of the casing 50 to the cover 40, and includes a number of apertures 59 formed therein and aligned with the holes 46 of the cover 40 respectively.

A guide plate 60 is disposed in the chamber 51 of the casing 50 and/or in the cap 56, and also includes one or more hubs or orifices 61 formed therein for receiving the posts 45 of the cover 40 respectively and for anchoring or positioning the guide plate 60 to the cover 40, and includes a number of nozzles 62 extended outwardly therefrom for engaging into or through the apertures 59 of the cap 56 and the holes 46 of the cover 40 respectively, and includes a number of orifices or passages 63 formed in or through the nozzles 62 respectively for allowing the water to flow from the chamber 51 of the casing 50 out through the orifices or passages 63 of the nozzles 62 of the guide plate 60.

Two distributors 70 each include a pipe 71 rotatably engaged into the bore 17 of the tube 16 respectively, and one or more sealing rings 72 engaged between the pipe 71 and the tube 16 for making or forming a rotatably water tight seal between the pipe 71 and the tube 16, and each include a mouth 73 formed therein or extended therefrom and engaged with the port 54 of the casing 50 for supplying the water from the tubes 16 into the chamber 51 of the casing 50 and then for allowing the water to flow from the chamber 51 of the casing 50 and then to flow out through the orifices or passages 63 of the nozzles 62 of the guide plate 60 for water spraying or showering purposes.

The distributors 70 each include a bar 74 extended therefrom and engaged with the studs 55 of the casing 50 and secured to the studs 55 of the casing 50 with such as fasteners 75 for solidly coupling or securing the casing 50 and the distributor 70 together, and each include a lever 76 extended therefrom and engaged with the posts 45 of the cover 40 respectively and secured to the posts 45 of the cover 40 with such as fasteners 77 for solidly coupling or securing the casing 50 and the cap 56 and the guide plate 60 and the cover 40 together, and for solidly coupling or securing the casing 50 and cover 40 to the distributor 70.

Figure 7:
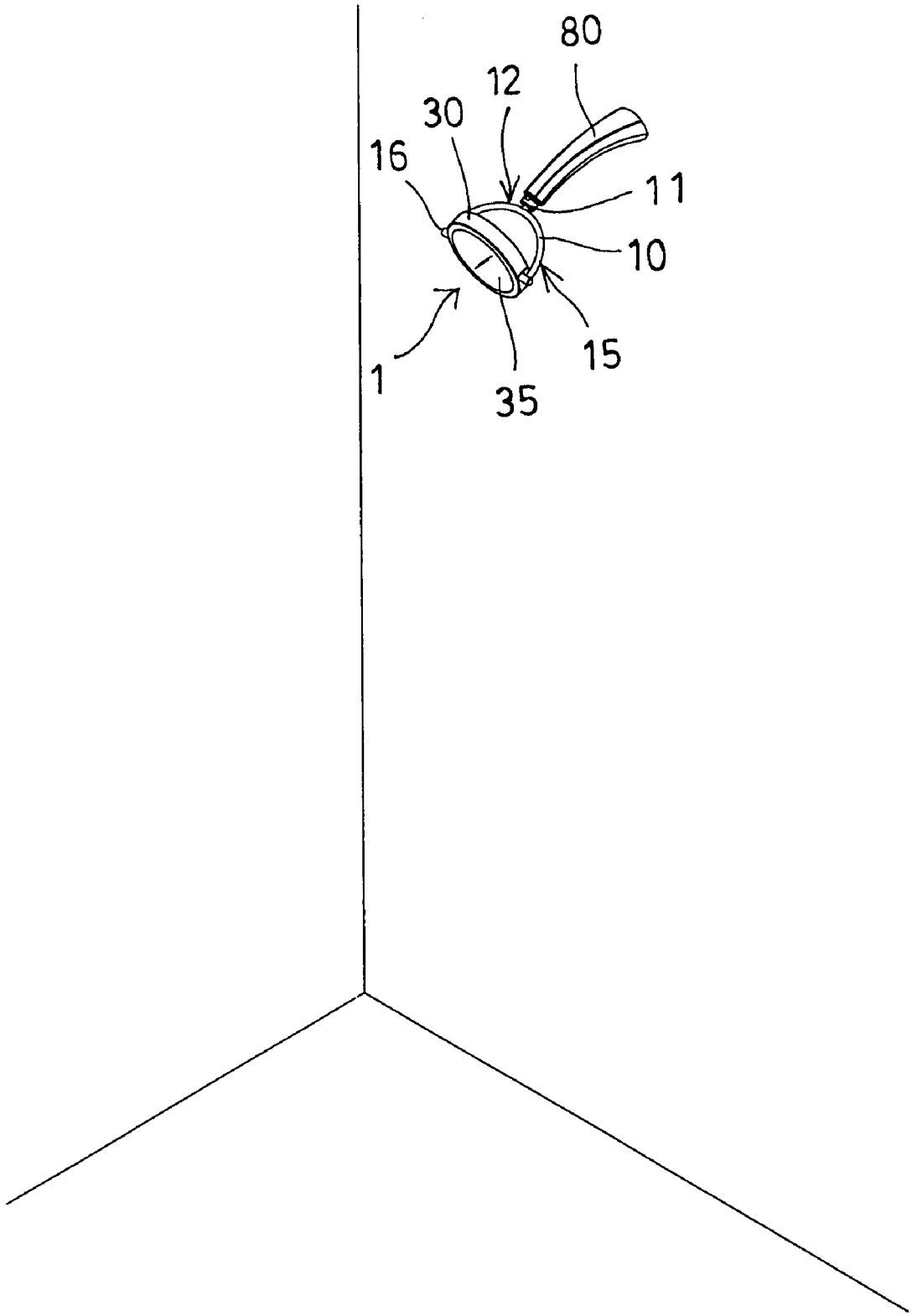
FIGS. 7, 8 are perspective views similar to FIG. 1, illustrating the operation of the shower device.
Figure 8:
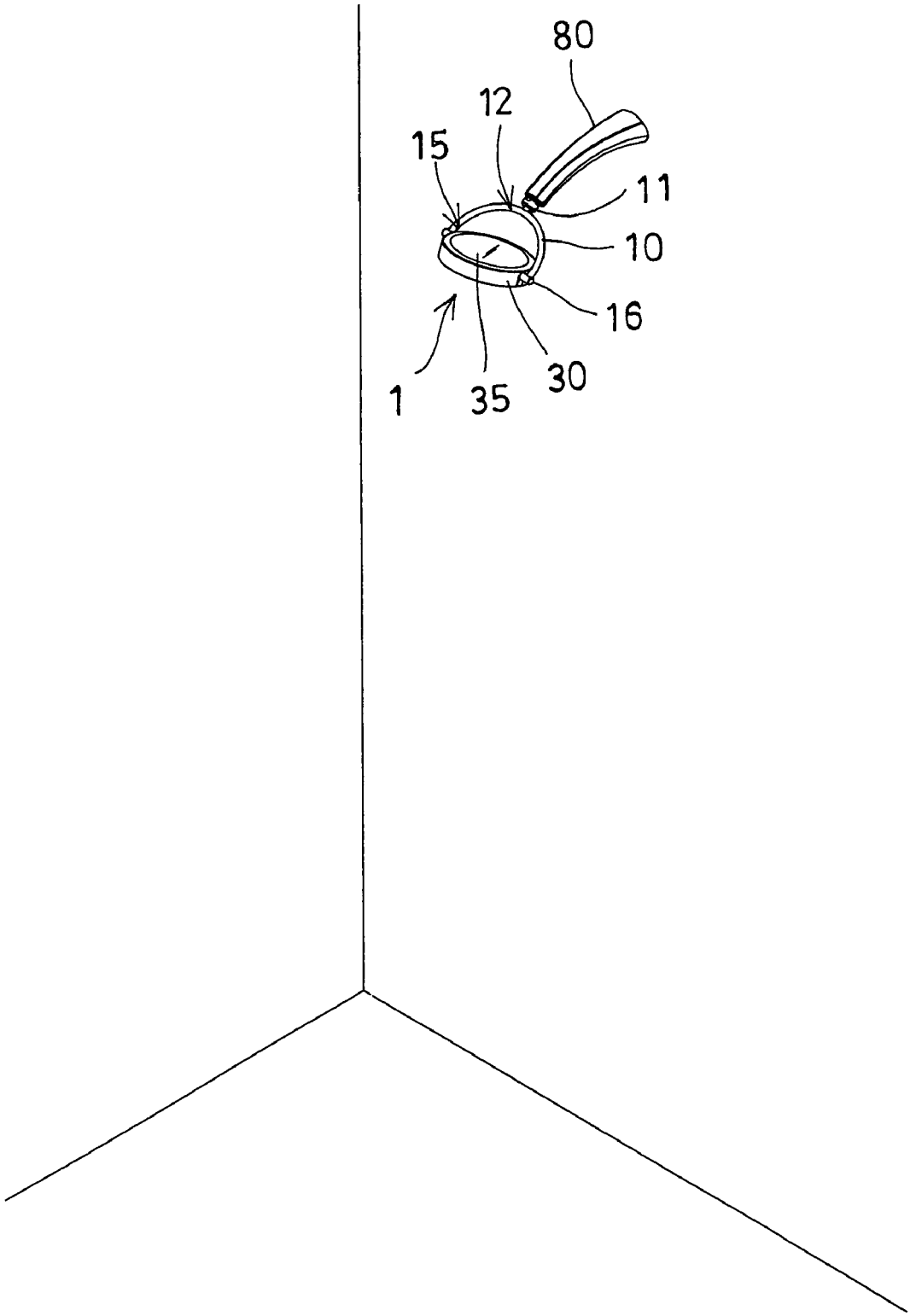

In operation, as shown in FIGS. 1 and 7-8, the shower housing 30 may be rotatably attached or secured or coupled to the frame 10 for allowing the housing 30 to be suitably rotated relative to the frame 10 to any suitable or selected angular position, and for allowing the orifices or passages 63 of the nozzles 62 of the guide plate 60 to be suitably rotated or directed toward the users (FIGS. 1, 8), and the mirror 35 may also be selectively or suitably rotated or directed toward the users (FIG. 7), the mirror 35 may also be directly shined or polished or formed on the rear or back portion of the housing 30.

Accordingly, the shower device in accordance with the present invention includes a pivotal structure for easily and readily and quickly attaching to a wall-mounted shower faucet or shower supply pipe and for allowing the shower device to be suitably operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pivotal shower device comprising:

a frame including a coupler provided and attached to a middle portion thereof and having an inner thread formed in said coupler for engaging with a wall-mounted shower supply pipe, and including a conduit formed in said frame and communicating with said coupler for receiving a water, said frame including two end portions each having a tube attached to said frame, and including a bore formed in each of said tubes and communicating with said conduit of said frame for receiving the water, and including a space formed between said tubes, and said tubes being aligned with each other in a longitudinal axis and each including an open end facing toward and communicating with said space of said frame, the water to flow from said chamber of said casing and to flow out through said cover, wherein said distributors each include a lever extended therefrom and engaged with said posts of said cover and secured to said posts of said cover, wherein said housing further includes a recess formed on an opposite second side of said housing, said recess receives and supports a mirror that attaches onto said housing, wherein said housing is pivoted in a direction perpendicular to the longitudinal axis to allow a user to switch back and forth between the shower and the mirror, wherein said casing, cap and guide plate are being disposed in said chamber of said housing between said cover and said mirror.

2. The pivotal shower device as claimed in claim 1, wherein said casing includes two studs extended therefrom, and said distributors each include a bar extended therefrom and engaged with said studs of said casing and secured to said studs of said casing.

3. The pivotal shower device as claimed in claim 1, wherein said housing includes at least one notch formed in said outer peripheral wall and communicating with said chamber of said housing, and said cover includes at least one catch extended out of said outer peripheral fence for engaging with said at least one notch of said housing and for anchoring said cover to said housing.

4. The pivotal shower device as claimed in claim 1, wherein said cap includes a plurality of apertures formed therein and aligned with said holes of said cover, respectively, and said plurality of nozzles of said guide plate engaged into said apertures of said cap and said holes of said cover, respectively.

* * * * *